US005407414A

United States Patent [19]

Bass

[11] Patent Number: 5,407,414

[45] Date of Patent: Apr. 18, 1995

[54] DOORWAY ATTACHED EXERCISE DEVICE FOR USE IN A STANDING OR SITTING POSITION

[76] Inventor: David Bass, 559 Atlantic Ave., East Rockaway, N.Y. 11518

[21] Appl. No.: 237,296

[22] Filed: May 3, 1994

[51] Int. Cl.[6] ..... A63B 21/04

[52] U.S. Cl. ..... 482/129; 482/904; 482/121

[58] Field of Search ..... 482/904, 121, 129, 40, 482/121, 122, 123, 130, 135, 136, 137, 139, 140

[56] References Cited

U.S. PATENT DOCUMENTS

| | | | |
|---|---|---|---|
| 3,815,904 | 6/1974 | Weiss et al. | 482/123 |
| 4,230,313 | 10/1980 | Chupp, Jr. | 482/140 |
| 4,240,626 | 12/1980 | Lambert, Jr. | 482/137 |
| 4,351,523 | 9/1982 | Alexander | 482/123 |
| 4,482,149 | 11/1984 | Weldon | 482/123 |
| 4,529,191 | 7/1985 | Miller et al. | 482/40 |
| 4,627,619 | 12/1985 | Rockwell et al. | 482/137 |
| 4,844,448 | 7/1989 | Niznik | 482/904 |
| 5,039,092 | 8/1991 | Olschansky et al. | 482/137 |
| 5,135,445 | 8/1992 | Christensen et al. | 482/129 |
| 5,256,126 | 10/1993 | Grotstein | 482/121 |

*Primary Examiner*—Richard J. Apley
*Assistant Examiner*—Lynne A. Reichard
*Attorney, Agent, or Firm*—Terry M. Gernstein

[57] ABSTRACT

An exercise device is releasably attached to a wall adjacent to a doorway and includes a spring-biased arcuate lever arm having a resilient pad on one end. A user leans against the pad and moves the lever arm against the force of the spring to exercise his or her abdominal muscles, oblique muscles and/or lower back muscles and/or neck muscles by using the device with the forehead, sides and back of head. This builds strength in the front neck muscles, the sides of the neck and the traps as well as the extensor muscles of the neck that hold the head up.

16 Claims, 3 Drawing Sheets

DOORWAY ATTACHED EXERCISE DEVICE FOR USE IN A STANDING OR SITTING POSITION

TECHNICAL FIELD OF THE INVENTION

The present invention relates to the general art of exercise devices, and to the particular field of exercise devices for exercising upper body torso muscles.

BACKGROUND OF THE INVENTION

Exercise has become a part of many people's daily or weekly routine. This exercise varies from extremely light to extremely vigorous, and the reasons for exercising vary with each individual as well. However, one common reason is to tone or strengthen muscles. Since many people suffer from lower back pain, a common reason for many exercise routines is to strengthen and/or tone the muscles associated with a person's back. This includes abdominal as well as oblique muscles in addition to the muscles in the lower back.

Therefore, the art includes many devices that can be used to exercise these muscles. While effective, these devices have several drawbacks which may reduce their appeal to some users. For example, some users do not want to, or cannot, lie down in a prone position for exercising. This may be a special problem if the exerciser has a weak or sore back.

More specifically, since many users have need to exercise all the muscles around the entire circumference of their body that are associated with the back, any exercise device should be capable of exercising these muscles without requiring the user to lie down. These muscles include the lower back muscles as well as the oblique muscles on the sides of the user's body and the abdominal muscles, that is the muscles around the user's waist.

Therefore, there is a need for a device which can exercise the abdominal, oblique and/or lower back muscles while the user remains in a standing position.

As the user's skills and strength increase, an exercise device should have the ability to correspondingly increase its resistance. However, such increase should be easily effected and precise so even an inexperience user will be able to precisely tailor the exercise device to his or her particular needs. Unfortunately, many exercise devices currently available are not amenable to easy, yet precise, adjustment.

Therefore, there is a need for an exercise device which is easily and precisely adjusted.

Still further, many exercise device require a great deal of space and are not easily set up and knocked down. Thus, a user must dedicate a great deal of space to the exercise device. This is not desirable, especially if the user lives in an apartment or other residence where storage space is limited.

Therefore, there is a need for an exercise device that can be easily set up, and requires very little space for storage or use.

OBJECTS OF THE INVENTION

It is a main object of the present invention to provide an exercise device that exercises the muscles around the user's waist and/or neck.

It is another object of the present invention to provide an exercise device that exercises the lower back muscles, the oblique muscles and the abdominal muscles and/or neck.

It is another object of the present invention to provide an exercise device that can be precisely adjusted.

It is another object of the present invention to provide an exercise device that is easily set up and knocked down.

It is another object of the present invention to provide an exercise device that does not require a great deal of space when set up.

SUMMARY OF THE INVENTION

These, and other, objects are achieved by an exercise device that can be removably attached to a wall adjacent to a door jamb and which has a padded cushion connected to a spring and which engages a user when that user is in a standing position. The user bends against the resistance of the spring to exercise the muscles around his or her waist. Bending to the side exercises the oblique muscles, and bending forward or backward exercises the abdominal and back muscles. The resistance of the device is altered by attaching an arcuate arm at various locations thereon to the spring. In this manner, the device can be quickly set up by merely attaching it to the wall adjacent to a door way, and leaning against the device while standing in the doorway.

BRIEF DESCRIPTION OF THE DRAWING FIGURES

DETAILED DESCRIPTION OF THE PREFERRED EMBODIMENT OF THE INVENTION

Figure 1:
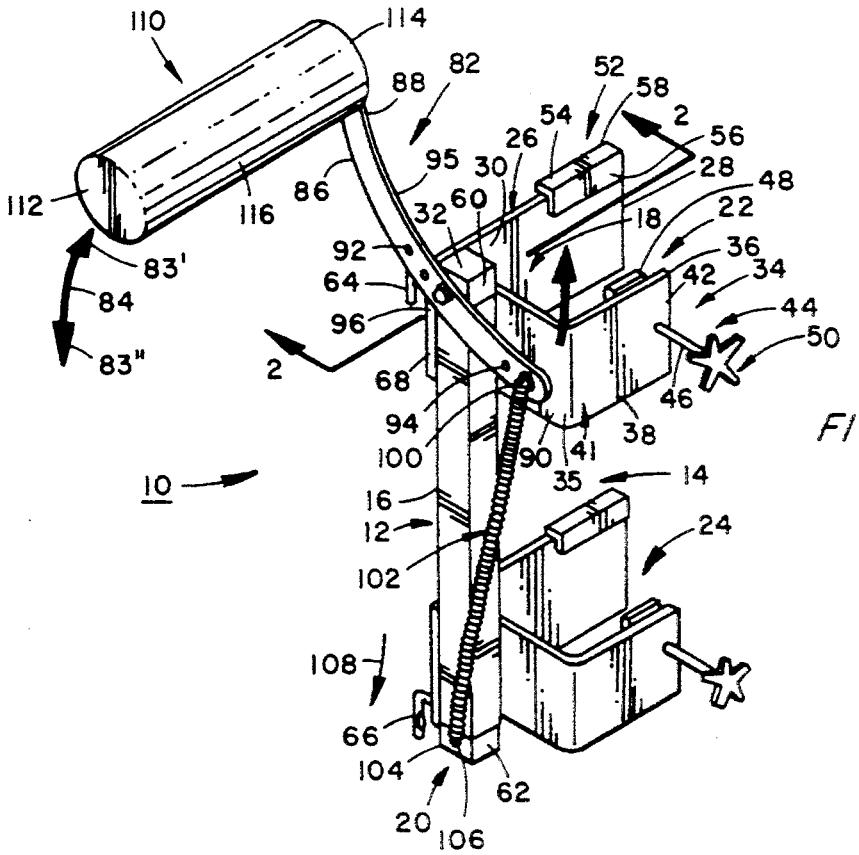
FIG. 1 is a front, top and side perspective view showing the exercise device embodying the present invention.

Shown in FIG. 1 is an exercise device 10 that can be mounted on a wall adjacent to a doorway and which can exercise the abdominal, oblique and lower back muscles of a user while that user remains in a standing position. Device 10 includes a mounting unit 12 that releasably attaches a resistance unit 14 to a wall. Device 10 is easily assembled and disassembled and can be stored in a small area so it can be quickly set up when it is to be used, yet can be stored in a small area when it is not in use.

More specifically, mounting unit 12 includes a support column 16 having a top end 18 and a bottom end 20. Column 16 can be hollow if desired, and includes a top clamp element 22, such as a C-clamp, fixedly mounted on the column top end, and a bottom clamp element 24 fixedly mounted on the column bottom end. Clamp elements 22 and 24 are identical, and thus, only clamp element 22 will be described. Clamp element 22 includes a rectangular base plate 26 fixed to the column 16 and extending outwardly therefrom to distal end 28. Top edge 30 is coplanar with top edge 32 of the column. An L-shaped clamp plate 34 is fixed to the column at its long leg 35 adjacent to plate 26 so top edge 36 of plate 34 is coplanar with top edge 30 and bottom edge 38 of plate 34 is coplanar with bottom edge 40 of plate 26. Plate 34 also includes a short leg 41 having a distal edge 42 spaced from long leg 35. A clamping screw 44 includes a thread 46 thereon and which is cooperatively received in a thread defined in backing element 48. Element 48 is padded and engages the wall adjacent to a doorway. Element 48 can be formed of rubber or other such material that will not mar the wall when clamping screw 44 is tightened down to mount device 10 to the wall. A handle 50 is mounted on an outer end of the screw whereby the screw can be easily operated to force element 48 against the wall.

A rear pad 52 is also fixed to plate 26. Pad 52 is formed of resilient material, such as rubber, which will not mar the wall if the pad is used to mount the device on a wall. Pad 52 is J-shaped, with a long leg 54 fixedly attached to the plate 26 and a short leg 56 extending over the top edge 30. A rubber cushion 58 is mounted on an outwardly directed face of the long leg. Pad 52 can be hung on a wall and interposed between element 48 and the wall to further prevent marring of the wall, and to ensure that device 10 is securely mounted on the wall. If not needed, the pad 52 can be removed and stored, or simply left in the position shown in FIG. 1. End caps 60 and 62 are mounted on the column 16 and are held thereon by means which can include clamps 64 and 66.

Figure 3:
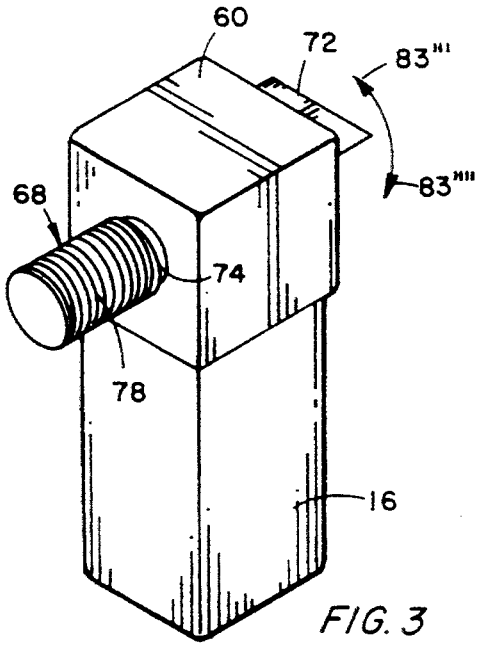
FIG. 3 is a perspective view of the top of the support column without the arcuate arm attached.
Figure 2:
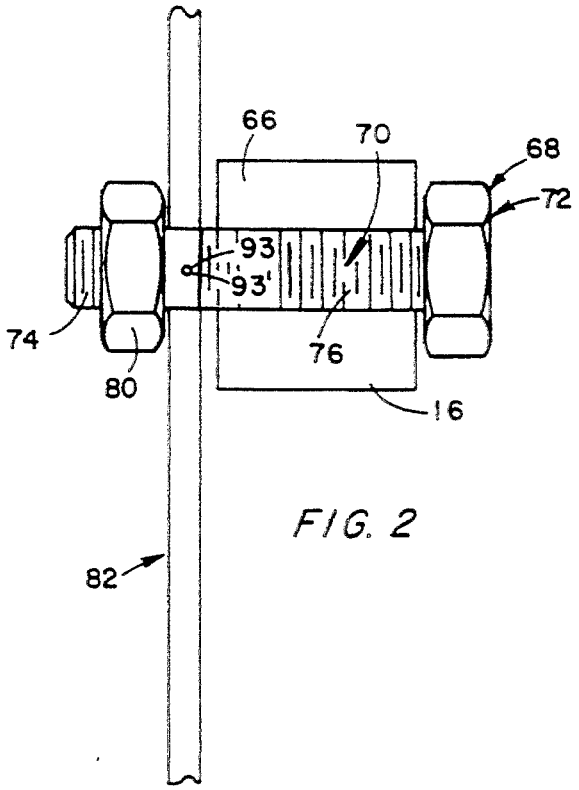
FIG. 2 is an elevational view showing the connection of an arcuate arm to a support column.
Figure 4:
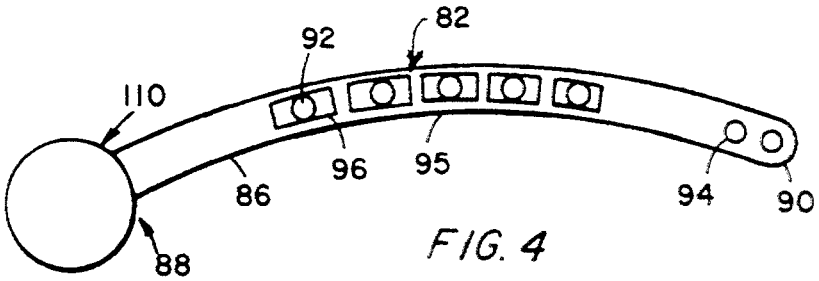
FIG. 4 is a rear plan view showing the arcuate exercise arm with mounting sleeves attached thereto.
Figure 5:
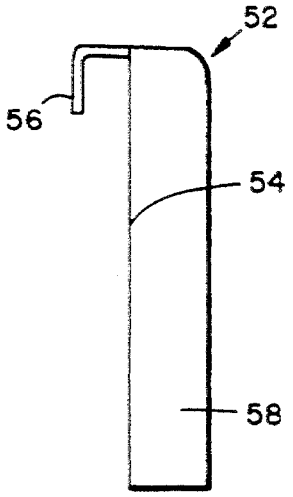
FIG. 5 is a side elevational view of a bracket used to mount the device to a wall adjacent to a doorway.

A pivot pin 68 is shown in FIGS. 1, 2 and 3 and is mounted on support column 16 and includes a body 70 having a head 72 on one end and a screw thread 74 on the other end thereof. A smooth shank section 76 separates screw thread 74 from head 72. A pin-receiving hole 78 is defined in body 70 to extend radially thereinto. Body 70 extends through aligned holes in end cap 60 and column 16 so head 72 abuts the end cap and screw thread 74 extends out of the end cap and hole 78 is located outside the end cap as shown in FIG. 2. A threaded nut 80 is mounted on the pivot pin via thread 74 for a purpose that will be understood from the following disclosure.

An arcuate lever arm 82 is mounted on the pivot pin to move in directions 83' and 83'' as shown by double-headed arrow 84 in FIG. 1. Lever arm 82 has a curved body 86 and ends 88 and 90, with a plurality of holes, such as hole 92, defined through the body at spaced apart locations near the center of the body, and a plurality of holes, such as hole 94, defined through the body near end 90. Lock washers, such as lock washer 96, are mounted on the lever arm adjacent to each of the holes 92 to provide a seating pad for nut 80 on the lever arm.

As shown in FIG. 2, bolt 68 fits through end cap 60 and column 16 and extends through hole 92 on lever arm 82 and through lock washer 96 with thread 74 extending out of lock washer to receive nut 80. Nut 80 is threadably attached to the pivot pin to attach the lever arm to the pivot pin. A second pin 93 is accommodated through a pin-receiving hole 94' defined through lever arm 82 from edge 95 and which intersects holes 92 and is received in hole 78 of pin 68 to further attach the lever arm to the pivot pin. As shown in FIG. 2, since the pivot pin is received through the aligned holes in the column and end cap at the trunk section of the pivot pin, that pin will rotate in directions 83''' and 83'''' which correspond to directions 83' and 83'' while the arm 82 is attached to the pivot pin. The holes 92 are spaced apart from each other so the lever arm can be mounted on the support column at different positions for a purpose that will be understood from the following discussion. Holes 94 are used to accommodate a hook end 100 of a spring 102 which has a second end 104 attached to a mounting pin 106 on the bottom end of the support column whereby spring 102 is stretched between pin 106 and hole 94. Spring 102 is a tension spring and exerts a bias on lever arm 82 in direction 108 tending to pivot that arm in direction 83' . The amount of bias exerted on lever arm 82 is adjusted by selection of holes 92 and 94. The amount of bias can also be altered by changing springs.

A cylindrical pad 110 includes a distal end 112 and a proximal end 114 connected by a surface 116 and is mounted on end 88 of lever 82. Pad 110 is formed of pliable material, such as plastic, or the like, and engages the user's body during use of device 10.

Figure 6:
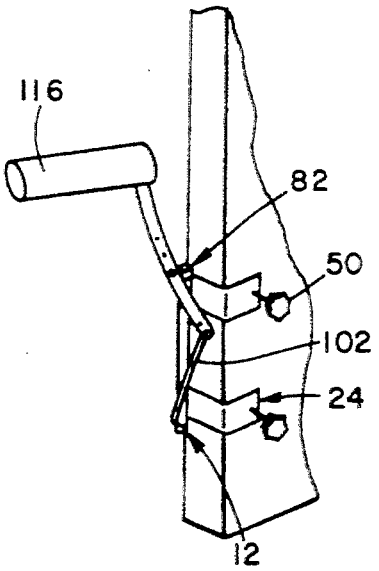
FIG. 6 shows the device mounted on a door jamb and extending into a doorway.

Thus, as shown in FIG. 6, device 10 is mounted on a door frame adjacent to a doorway or other open area into which pad 110 can extend, spring 102 is attached to the lever arm, and the lever arm is attached to the pivot pin. A user, in the standing position, leans on the pad 110 and forces that pad in direction 83'' against the bias of spring 102. When the user relaxes, the spring moves the pad in direction 83' and returns the pad to its rest position. The user then repeats the process.

Figure 7:
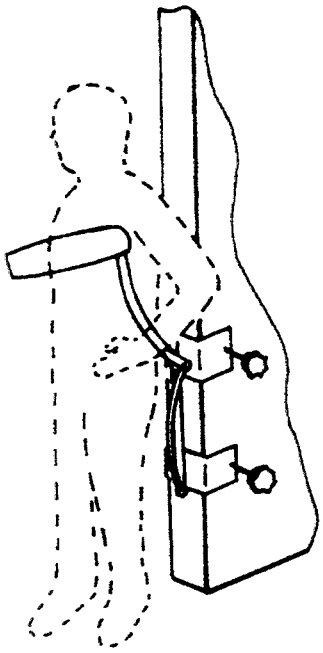
FIGS. 7–10 show the device in use.
Figure 8:
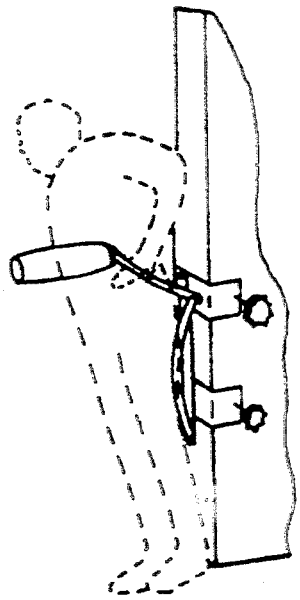
Figure 9:
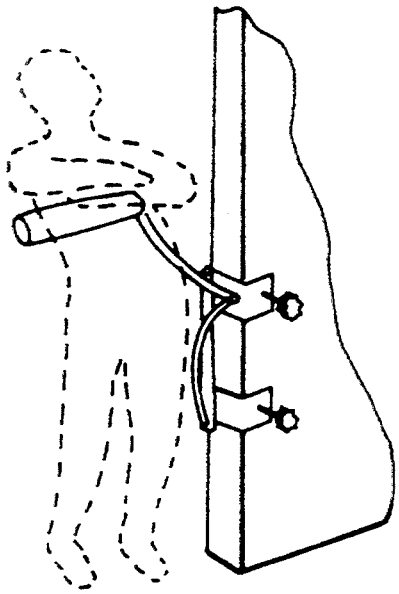
Figure 10:
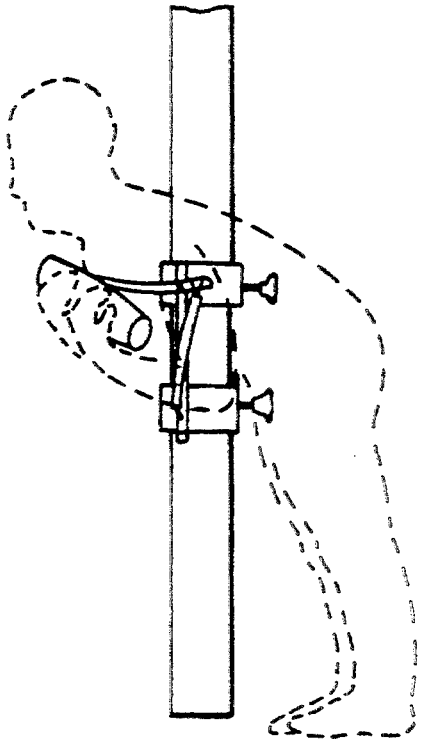

As shown in FIGS. 7 and 8, a user can exercise his oblique muscles by leaning side to side against the bias of spring 102, or can exercise the muscles in his lower back, as shown in Figure 9 by pressing backwards against the spring bias, or can exercise his abdominal muscles as shown in FIG. 10 by pressing forward on the pad 110. In this manner, a user can exercise the muscles around his or her waist while standing up. Once the exercise program is completed, the device can be removed from the wall, dismantled and stored.

The device can also be used to exercise the front, sides and back of the neck. By raising the unit on the door jamb from the position discussed above, a user can exercise his or her neck by sitting in a chair and pushing the cushioned resistance pad with the front, side and back of his or her head. People with chronic neck pain or weak neck muscles or those who suffer with neck pain from computer or desk work will benefit from the use of the device disclosed herein. This device can also be used to rehabilitate injuries.

It is understood that while certain forms of the present invention have been illustrated and described herein, it is not to be limited to the specific forms or arrangements of parts described and shown.

I claim:

1. An exercise device comprising:

A) a mounting unit including (1) clamp means for releasably attaching said mounting unit to a wall adjacent to a doorway, and (2) a tension spring attached at one end thereof to said clamp means, B) an arcuate lever arm pivotally mounted on said clamp means and having first and second ends, said lever arm being connected to said clamp means between the ends thereof;

C) said spring being connected to said lever arm at one end of said lever arm; and D) a resilient pad mounted on said second end of said lever arm and extending at a right angle to said lever arm and extending away from the wall when said mounting unit is attached to the wall.

2. The exercise device defined in claim 1 wherein said clamp means includes a main column post, and a C-clamp mounted on each end of said post.

3. The exercise device defined in claim 2 further including a pivot pin mounted on said post and a plurality of pin-receiving holes defined through said lever arm at spaced apart locations.

4. The exercise device defined in claim 3 further including a lock washer means on said lever arm adjacent to each pin-receiving hole for locking said lever arm to said pivot pin.

5. The exercise device defined in claim 4 further including a lock pin receiving hole defined through said lever arm and intersecting one of said pin-receiving holes, a second lock pin means for locking said lever arm to said pivot pin via said first and second lock pin-receiving holes.

6. The exercise device defined in claim 5 further including thread means for threadably locking each lock washer means to said pivot pin.

7. The exercise device defined in claim 6 further including a rubber pad mounted on one of said C-clamp.

8. The exercise device defined in claim 7 further including a J-shaped backing element on each C-clamp.

9. The exercise device defined in claim 2 further including a cube-shaped element on each end of said main post.

10. The exercise device defined in claim 9 further including attaching means for releasably attaching each cube-shaped element to said main post.

11. The exercise device defined in claim 10 wherein said attaching means includes a lock pin.

12. The exercise device defined in claim 3 wherein said pivot pin includes a bolt having a head on one end and a thread on another end with a thread-free trunk between the thread and the head.

13. A method of exercising a user's lower back muscles, oblique muscles and abdominal muscles comprising:

A) providing an exercise device comprising: a mounting unit including clamp means for releasably attaching said mounting unit to a wall adjacent to a doorway, and a tension spring attached at one end thereof to said clamp means, an arcuate lever arm pivotally mounted on said clamp means and having first and second ends, said lever arm being connected to said clamp means between the ends thereof; said spring being connected to said lever arm at one end of said lever arm; and a resilient pad mounted on said second end of said lever arm and extending at a right angle to said lever arm and extending away from the wall when said mounting unit is attached to the wall;

B) standing upright next to the resilient pad;

C) contacting the resilient pad with the upper body;

D) forcing the resilient pad and lever arm to move against the bias of the spring using the body.

14. The method defined in claim 13 wherein said step of forcing the resilient pad and lever arm to move includes using the lower back muscles.

15. The method defined in claim 13 wherein said step of forcing the resilient pad and lever arm to move includes using the abdominal muscles.

16. The method defined in claim 13 wherein said step of forcing the resilient pad and lever arm to move includes using the oblique muscles.

* * * * *